United States Patent [19]

Jones

[11] Patent Number: 4,771,226

[45] Date of Patent: Sep. 13, 1988

[54] VOLTAGE REGULATOR FOR LOW VOLTAGE, DISCHARGING DIRECT CURRENT POWER SOURCE

[75] Inventor: Byron Jones, Chattanooga, Tenn.

[73] Assignee: Seco Industries, Inc., Cleveland, Tenn.

[21] Appl. No.: 11,032

[22] Filed: Feb. 5, 1987

[51] Int. Cl.[4] ..... G05F 5/08

[52] U.S. Cl. ..... 323/303; 323/275; 323/281

[58] Field of Search ..... 323/265, 275, 281, 303, 323/349

[56] References Cited

U.S. PATENT DOCUMENTS 4,633,162 12/1986 Melbert ..... 323/275

FOREIGN PATENT DOCUMENTS 0154019 9/1983 Japan ..... 323/281

0157726 9/1984 Japan ..... 323/303

*Primary Examiner*—Patrick R. Salce

*Assistant Examiner*—Judson H. Jones

*Attorney, Agent, or Firm*—Renner, Otto, Boisselle & Sklar

[57] ABSTRACT

A voltage regulator powered by an electrical power source having a discharging voltage characteristic and regulating the voltage applied to an electrical load from the power source includes a stable reference voltage source, a sensor for sensing the voltage applied to the load, an error signal generator for generating an error signal related to the difference between the sensed and reference voltages, and a voltage control connected in series with the electrical load and responding to the error signal to control the voltage applied to the load as the power source discharges. The invention is particularly useful when the power source is a single cell battery and the load is a direct current motor. Embodiments of the invention may apply a substantially constant or an increasing voltage to a load as the source voltage declines according to its discharge characteristic. Embodiments of apparatus according to the invention may be conveniently and economically built using commercially available integrated circuits and transistors.

15 Claims, 1 Drawing Sheet

VOLTAGE REGULATOR FOR LOW VOLTAGE, DISCHARGING DIRECT CURRENT POWER SOURCE

BACKGROUND

This invention concerns electronic circuitry for regulating, in a predetermined way, an output voltage that is produced by a direct current power source having a discharging voltage characteristic. The invention particularly concerns simple, economical circuitry for regulating an output voltage produced by a single cell battery that powers an electrical load and also powers the regulating circuitry.

Battery powered electrical apparatus is pervasive. In many applications, batteries are installed and the apparatus is used until the batteries are exhausted, when they are replaced. With many kinds of electrical or electronic apparatus, the gradual decline of battery voltage as the battery discharges does not significantly affect performance of the apparatus. In other electrical or electronic devices, a decline in battery voltage directly influences some operating characteristic. For example, where a battery, such as a common D-size cell, drives a direct current motor, the motor speed will decline as the battery discharges and its voltage decreases.

In one battery powered apparatus of particular interest a single cell battery continuously operates a direct current fan motor blowing air over a controlled volatility odor control product. Periodically the odor control product is replaced and, preferably, at the same time, the battery is replaced. In order to dispense the odor control product at a substantially constant rate, assuming no change in its volatility, it is necessary to maintain the fan at a substantially constant speed between battery changes If the odor control product volatility decreases as its source is depleted, it is desirable to increase the fan motor speed as the time for battery replacement grows closer. To achieve these respective ends, the voltage supplied to the motor from the battery must remain substantially constant or increase with time while the battery is discharging and its voltage is decresing.

While voltage regulators are commonly used to produce a substantially constant output voltage from a varying amplitude input voltage, regulating the output voltage from a low voltage discharging source, such as a single cell battery, is a challenging task. The total amount of power available to operate both the regulator and other apparatus is limited by the battery source. The amount of energy consumed by the regulator must be minimized so as not to shorten battery life unduly. Moreover, the voltage difference between that applied to the electrical load and the battery voltage (including the difference between the fully charged battery voltage and the discharged battery voltage) must be minimized so that sufficient voltage is available to operate an electrical load. Finally, apparatus intended to be operated by a single cell battery is likely to be lightweight and inexpensive. Therefore, a regulator powered by and regulating the voltage from the cell must also be lightweight and inexpensive to be practical.

SUMMARY OF THE INVENTION

In the invention, circuitry that is lightweight, relatively inexpensive, consumes little power and introduces a relatively small voltage drop between a discharging voltage power source and an electrical load, is provided to regulate an output voltage that is very low, i.e. on the order of one volt. The circuitry includes a transistor that, through its emitter and collector terminals, is in electrical series with the load. The battery voltage is applied directly to the series-connected load and transistor. The voltage across the load is sensed and a portion of it is compared to a reference voltage. Any change in the difference between the reference voltage and sensed portion of the load voltage produces an error signal that is applied to the base of the transistor to adjust its net collector to emitter voltage and therefore the voltage on the load. An integrated circuit can conveniently supply most of the needed elements of the regulator in a lightweight, economical package. The novel circuit can maintain a substantially constant voltage across the electrical load as a battery powering the circuit and the load discharges. By adding appropriate feedback elements, an embodiment of the regulator can provide a voltage applied to the load that increases as the battery discharges.

DETAILED DESCRIPTION OF PREFERRED EMBODIMENTS

Figure 1:
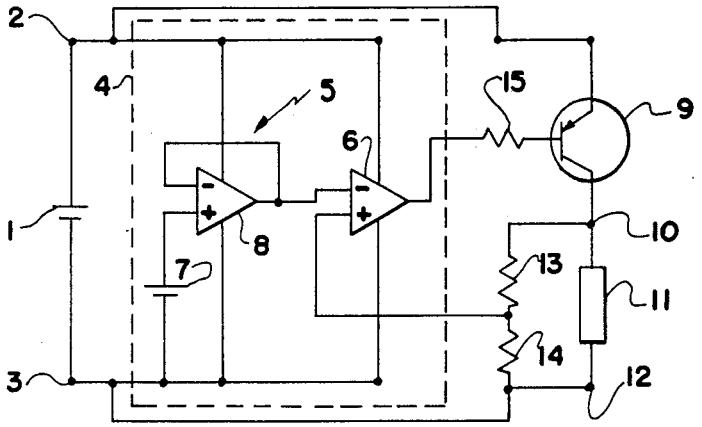
FIG. 1 is a schematic diagram of a regulator circuit according to an embodiment of the invention.

A schematic diagram of an output voltage regulator circuit according to the invention is shown in FIG. 1. The regulator circuit is powered by and regulates an output voltage produced by a direct current power source having a discharging voltage characteristic shown as a single cell battery 1. Cell 1 may be any sort of battery, such as a common carbon-zinc, alkaline or nickel-cadmium cell. As is well known, these cells have a maximum voltage determined by the electrode materials and, to a lesser degree, by the electrolyte with which the electrodes are in communication. As an electrical current is withdrawn from the cells, they discharge so that the voltages produced between their electrodes decline. The discharge rate is determined, in large measure, by the rate at which current is withdrawn. Eventually the battery voltage declines to a value below the minimum acceptable for powering a particular load. Then the battery is fully consumed or discharged and, unless it is rechargeable, must be discarded. With the invention, the portion of the output voltage produced by cell 1 that is applied to an electrical load is maintained at a substantially constant value, or changed in another preselected way, during cell discharge. As a result, the useful life of the cell, as measured by the voltage available to power and external load, is extended.

In many situations where the invention is useful, long battery life and small battery volume are essential considerations. For example, when the invention is used in an odor control product dispenser of the type previously mentioned, the volume of the dispenser enclosure is desirably kept as small as possible. In that use, a battery powered fan continuously blows air over a volatile odor control product. For reasons of economy, the fan motor battery should preferably not require more frequent attention than the odor control product source, e.g. replacement no more frequently than about once per month. In addition, battery cost must be minimized. For these reasons, a single cell, carbon-zinc battery is the optimum power supply choice for that application. Since a single cell carbon-zinc battery has a maximum nominal output voltage of 1.5 volts, it is critical that the novel regulator prevent very little of the battery voltage from reaching the load, i.e. the motor. At least about 1.0 volt is needed to operate a direct current motor. The invention readily achieves this goal and is particularly described with respect to it. The invention is also useful with multiple cell, higher voltage discharging sources, particularly where only small voltage losses in a regulator are tolerable. However, higher voltage sources are likely to be more amenable to larger voltage losses. Therefore, the invention has particular utility with single cell battery sources.

Battery 1, such as a carbon-zinc D-size cell, is electrically connected to the circuit at input terminals 2 and 3. Battery 1 powers an integrated circuit (indicated within broken lines) that includes a reference source 5 and a difference amplifier 6. Reference source 5 acts as if a reference voltage source 7 were connected to the positive sense input terminal of a difference amplifier 8 that has its output signal directly connected to its negative sense input terminal. Amplifier 8 thus generates a stable voltage signal at its output terminal that is applied to the negative sense input terminal of difference amplifier 6. A convenient, low power consumption integrated circuit that can be powered by a 1.5 volt cell and provide the functions of integrated circuit 4 just described in the LM10CLN manufactured by National Semiconductor. It should be understood that in the integrated circuit reference voltage source 7 is not a separate cell. However, the integrated circuit behaves, in part, as if it contained a voltage reference source such as source 7.

The emitter electrode of a pnp transistor 9 is connected to input terminal 2, i.e. the anode of cell 1. The collector electrode of transistor 9 is connected to an output terminal 10 of the regulator circuit. One terminal of a two terminal electrical load 11 (such as a direct current motor) is also connected to output terminal 10. The other terminal of load 11 is connected to the circuit's other output terminal 12, which is also connected to input terminal 3 and to the cathode of cell 1. Thus the voltage produced by cell 1 is divided between load 11 and the net emitter to collector voltage of transistor 9. A voltage divider composed of two series-connected resistors 13 and 14 is connected in parallel with load 11. The junction of resistors 13 and 14 is electrically connected to the positive sense input terminal of difference amplifier 6. The output terminal of amplifier 6 is connected through a resistor 15 to the base electrode of transistor 9.

The total resistance of resistors 13 and 14 is chosen to be much larger than that of load 11 to avoid excessive current flow through and power consumption by the resistors. The ratio of the resistance of resistor 14 to the sum of the resistances 13 and 14 is chosen so that a preselected portion of the voltage across load 11 is fed to difference amplifier 6. The output signal from amplifier 6 to the base electrode determines the operating point of transistor 9.

In operation, the voltage across resistor 14 is held nearly constant by the regulating action of difference amplifier 6 and transistor 9. If the voltage across load 11 decreases slightly, the voltage across resistors 13 and 14 decreases slightly. This voltage decrease produces an error voltage at the positive sense input to difference amplifier 6 that increases the current flowing from amplifier 6 to the base of transistor 9. This increased current flow causes the voltage drop across the emitter and collector electrodes of the transistor to decrease. The declining voltage across the load is restored by the decrease in voltage across the transistor. When cell 1 is new, its voltage is substantially higher than the voltage required by the load. The difference between the load voltage and the cell voltage is dropped across the transistor. As cell 1 discharges, its voltage decreases and the voltage drop across the transistor decreases so that the load voltage remains substantially constant. As the output voltage of cell 1 decreases further and further, the voltage across the load remains substantially constant until the voltage drop across the emitter and collector electrodes of transistor 9 declines to about 0.1 volts. A transistor that can operate down to such a low emitter to collector voltage is important in order to prolong the time that the load voltage remains substantially constant.

Transistor 9 must have a low net voltage drop between its emitter and collector in order to be useful with a single cell power source. The voltage drop across the forward biased emitter-base junction will be about 0.5 volt so that the voltage drop across the reverse biased collector-base junction should never exceed about 1.0 volt at the desired collector current to power a 1.0 volt load from a 1.5 volt cell. (Loads having higher or lower voltage needs require smaller voltage losses or can tolerate higher voltage drops across transistor 9, respectively.) The gain of the transistor should be relatively high to provide good response to small declines in cell voltage. A 2N3906 transistor available from Motorola provides good performance in operation of a nominal 1.0 volt direct current motor powered by a single carbon-zinc cell. With the active components already identified, resistors 13, 14 and 15 may have values of 10,000, 2200 and 150 ohms, respectively. The circuit of FIG. 1 can provide a substantially constant voltage powering a direct current motor continuously at substantially constant speed for more than one month from a single D-size carbon-zinc cell. The regulator circuit embodiment shown increases power dissipation over that of the load by only a few milliwatts at most.

Figure 2:
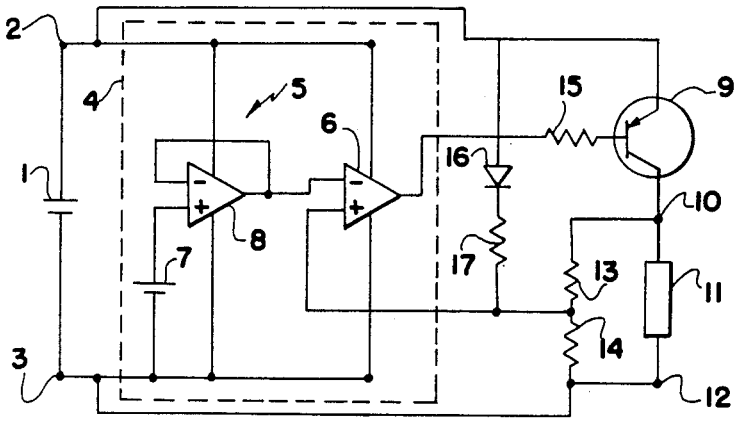
FIG. 2 is a schematic diagram of an alternative embodiment of a regulator circuit according to the invention.

An alternative embodiment of the invention is shown in FIG. 2. All components are the same as those shown in FIG. 1, except that the anode of a diode 16 is connected to the emitter of transistor 9 and a resistor 17 is connected from the cathode of diode 16 to the positive sense input terminal of amplifier 6. Resistor 17 has a relatively high resistance, e.g. sixty-eight thousand ohms, so that little current flows through it. Diode 16, any common diode such as a 1N4148, has a non-linear voltage characteristic in forward bias. Series connected diode 16 and resistor 17 provides a voltage offsetting feedback connection between the emitter and collector of transistor 9 that modifies the response of the circuit to the discharging voltage of cell 1. As the voltage of cell 1 declines, the current through resistor 17 changes, but in a non-linear way because of the non-linear characteristic of diode 16. The additional current path provided by diode 16 and resistor 17 produces a shift in the voltage across resistor 14 from the value otherwise present. The shift becomes more pronounced as cell 1 discharges and produces an increased error signal from amplifier 6 with increasing cell discharge. As a result, as cell 1 is discharging, the voltage applied to load 11 is not constant, but gradually increases as the error signal is gradually offset more and more from the point needed to maintain a constant voltage on load 11. When load 11 is a direct current motor, the regulator circuit of FIG. 2 gradually increases motor speed as the battery discharges.

If load 11 is inductive, such as a motor, it may be wise to include a diode in embodiments of the invention to protect transistor 9. Otherwise, reverse current flows that could result when the inductors' magnetic fields collapse, e.g. when the motor is turned off, could damage the transistor.

The invention has been described with respect to certain preferred embodiments. Various modifications within the spirit of the invention will occur to those skilled in the art. Accordingly, the scope of the invention is limited solely by the following claims.

I claim:

1. A voltage regulator powered by an electrical power source having a discharging voltage characteristic and regulating the voltage applied to an electrical load from said power source, said regulator comprising:

first and second input terminals for electrically connecting an electrical power source having a discharging voltage characteristic to said regulator to power said regulator and to supply a voltage for regulation;

first and second output terminals for connecting an electrical load to a voltage from said source regulated by said regulator, said second input and output terminals being electrically connected together;

reference source means for generating a reference signal;

difference means receiving said reference signal, an offset voltage and a portion of the regulating voltage applied to said load, for generating an error signal in response to the offset voltage and the difference between said reference signal and said portion of the regulated voltage applied to said load;

control means having input, control and output electrodes, said input electrode being electrically connected to said first input terminal, said control electrode receiving said error signal and said output electrode being electrically connected to said first output terminal, for producing a voltage drop between said input and output electrodes that changes in response to the error signal applied to said control electrode;

sensing means for sensing the regulated voltage applied to said load, and for producing said portion of said regulated voltage received by said difference means; and voltage offset means connected between said input electrode and sensing means for generating said offset voltage, said offset voltage being related to the voltage of said discharging source and being received by said difference means, and for increasing the voltage applied to said load at said output terminals as the voltage applied to said input terminals by said power source decreases.

2. The regulator of claim 1 including, as said power source electrically connected to said input terminals, a single cell battery.

3. The regulator of claim 1 including, as said electrical load, a direct current motor electrically connected to said output terminals.

4. The regulator of claim 1 wherein said reference means and said difference means comprise a single integrated circuit powered by said power source.

5. The regulator of claim 1 wherein control means comprises a transistor.

6. The regulator of claim 5 wherein said input, control and output electrodes comprise the emitter, base and collector of said transistor, respectively.

7. The regulator of claim 1 wherein said voltage offset means comprises a diode and resistor electrically connected in series at a common terminal, the non-common terminal of said diode being electrically connected to one of said input electrode and said sensing means, the non-common terminal of said resistor being electrically connected to the other of said input electrode and said sensing means.

8. The regulator of claim 7 wherein control means comprises a transistor.

9. The regulator of claim 1 wherein said sensing means comprises signal dividing means electrically connected in parallel with said output terminals for dividing the voltage applied to said load into at least two portions, one of said portions being received by said difference means.

10. The regulator of claim 9 wherein said signal dividing means comprises at least two resistors electrically connected in series at a common terminal, the common terminal being electrically connected to said difference means.

11. The regulator of claim 1 wherein said voltage offset means comprises passive electrical components, at least one of said components having a non-linear electrical characteristic.

12. A voltage regulated power supply for a direct current electrical power source having a discharging voltage characteristic comprising a direct current electrical motor as a load, reference means for generating a stable reference voltage, sensing means for sensing the voltage applied to the motor and for producing a portion of said voltage applied to the motor, error signal generating means receiving said portion of said voltage applied to the motor, said reference voltage and an offset voltage, for generating an error signal related to the offset voltage and the difference between the portion of the voltage applied to the motor and the reference voltage, a transistor having emitter, base and collector electrodes, said emitter and collector electrodes connected in series between the power source and the motor, said base electrode receiving said error signal for producing a voltage drop across the emitter and collector electrodes of the transistor that changes in response to the error signal, and voltage offset means connected between said emitter and said sensing means for generating said offset voltage related to the voltage of said source for increasing the speed of said motor as said power source discharges.

13. The regulator of claim 12 wherein said voltage offset means comprises a diode and resistor each having first and second terminals, wherein said diode and resistor are electrically connected in series at said first terminals, the second terminal of said diode is electrically connected to one of said emitter electrode and said sensing means, the non-common terminal of said resistor is electrically connected to the other of said emitter electrode and said sensing means.

14. A voltage regulated power supply for an electrical load rated at no more than about 1.5 volts comprising a single cell discharging battery producing an output voltage of no more than about 1.5 volts when fully charged, reference means for generating a stable reference voltage, sensing means for sensing the voltage applied to said load and for producing a portion of said voltage applied to said load, error signal generating means receiving said portion of said voltage applied to said load and said reference voltage for generating an error signal related to the difference between the portion of the voltage applied to the load and the reference voltage, and a transistor having emitter, base and collector electrodes, said emitter and collector electrodes connected in series between said battery and said load, said base electrode receiving said error signal for producing a voltage drop across the emitter and collector electrodes of the transistor that changes in response to the error signal, wherein said single cell battery supplies all the electrical power applied to said reference means, said error signal generating means, said sensing means and said load, and voltage offset means connected between said emitter and said sensing means for generating an offset voltage related to the voltage of said battery and for increasing the regulated voltage applied to said load as the battery discharges.

15. The regulator of claim 14 wherein said voltage offset means comprises a diode and resistor, each having first and second terminals, and wherein said diode and resistor are electrically connected in series at said first terminals, the second terminal of said diode is electrically connected to one of said emitter electrode and said sensing means, and the second terminal of said resistor is electrically connected to the other of said emitter electrode and said sensing means.

* * * * *